United States Patent [19]

Day et al.

[11] Patent Number: 4,667,397

[45] Date of Patent: May 26, 1987

[54] ELECTRICAL LEAD WIRE AND TERMINAL SPLICING MACHINE

[75] Inventors: James C. Day; Gerald Payne, both of Owensboro, Ky.

[73] Assignee: Premium Allied Tool, Inc., Owensboro, Ky.

[21] Appl. No.: 749,394

[22] Filed: Jun. 27, 1985

[51] Int. Cl.[4] ..... H01R 43/048

[52] U.S. Cl. ..... 29/748; 29/33 F; 29/33 M; 29/564.6; 29/566.2; 29/566.3

[58] Field of Search ..... 29/33 F, 33 K, 33 M, 29/33.5, 564.3, 564.4, 564.5, 564.6, 565, 566.1, 566.2, 566.3, 748, 755

[56] References Cited

U.S. PATENT DOCUMENTS

| | | | |
|---|---|---|---|
| 2,768,425 | 10/1956 | Andren | 29/33 M X |
| 2,908,910 | 10/1959 | Andren | 29/33.5 |
| 2,954,599 | 10/1960 | Cootes et al. | 29/33 M X |
| 3,155,136 | 11/1964 | Laskowski | 29/33.5 |
| 3,292,236 | 12/1966 | Busler et al. | 29/33.5 |
| 3,412,445 | 11/1968 | Schroeder | 29/33.5 |
| 3,848,316 | 11/1974 | Bakermans et al. | 29/566.2 X |
| 4,546,526 | 10/1985 | Dusel et al. | 29/564.4 X |
| 4,554,725 | 11/1985 | Over et al. | 29/564.4 |

FOREIGN PATENT DOCUMENTS

| | | | |
|---|---|---|---|
| 167620 | 5/1956 | Australia | 29/33 F |

*Primary Examiner*—Howard N. Goldberg
*Assistant Examiner*—Joseph M. Gorski
*Attorney, Agent, or Firm*—Maurice L. Miller, Jr.

[57] ABSTRACT

A die set assembly for crimp connecting an electrical lead to terminals or the like. The device includes apparatus for cooperatively feeding the length of electrical lead, a length of terminal, and a crimp connector strip, carrying series of crimp connectors. The device further includes apparatus for adjustably positioning a cutter relative to the die set assembly, whereby when the length of electrical lead and crimp connector strip have been positioned in the machine, and the terminal length determined, the machine will crimp a crimp connector, a lead and predetermined length of terminal and sever the crimp connector from the strip and cut a predetermined length of terminal.

15 Claims, 6 Drawing Figures

ELECTRICAL LEAD WIRE AND TERMINAL SPLICING MACHINE

FIELD OF THE INVENTION

This invention relates to an apparatus for joining conductors and more particularly to the joining together of an insulated wire and a gold plated wire by means of a gold crimping clip.

BACKGROUND OF THE INVENTION

In the past, various devices have been developed for cutting a predetermined length of gold wire and simultaneously crimping the gold wire to an insulated wire by means of a metallic crimping clip. A typical such device includes a press unit and a die set having various crimping and cutting tools. These previously employed devices have the disadvantages that the length of the gold wire extending from the crimp was dependent on the tools which were set into the press unit. Each time a new length was desired, it was necessary to change the tools in the press. This required removing the die set from the press unit, changing inserts in the die sets, and reinstalling the die set into the press unit. This operation—going from one wire length to another, was very time consuming.

OBJECTS

It is an object of this invention to provide a means for rapidly connecting a lead wire to a terminal wire by use of a crimp connector.

Another object of this invention is to provide a device for connecting a lead wire to a terminal wherein the length of terminal wire to be cut may be changed quickly and easily.

Still another object of the invention is to provide a system to cut gold terminal wire off at a specified length, to cut a partially-formed length of gold splice crimp off of its carrier strip and terminate them to a lead wire which is being fed into the system.

Yet a further object of the invention is to provide a system for connecting a terminal wire to a lead wire, which has the capability to change lengths of terminal wire to be cut without changing tool inserts in the device.

Still another object of this invention is to provide a die set assembly having punch means, crimp means, a movable cut-off punch and die holder assembly and means for adjusting the position of the cut-off punch and die holder assembly relative to the die set.

Still another object of the invention is to provide a die set assembly wherein the means for adjusting the position of the cut-off punch and die holder assembly includes a support member fixed to the die set and a movable member, extending between the support member and the cut-off punch and die holder assembly, positionable with respect to the support member and secured to the cut-off punch die holder assembly.

Another object of the invention is to provide a cutter adjustment means and driving mechanism so positioned as to not interfere with other feed means.

A further object of the invention is to provide accessibility to the mechanism for making the adjustments to the cutter so the cutter can be changed readily by use of a simple tool.

Still another object of the invention is to provide a device for connecting a lead wire to a terminal wire which does not require a complete change of equipment and can be adapted to presently used standard equipment.

SUMMARY OF THE INVENTION

In summary, this invention is designed to provide a machine for crimp connecting an electrical lead wire to a terminal wire or the like including means for cooperatively feeding a length of electrical lead, a length of terminal and a crimp connector strip carrying a series of crimp connectors. Further, the device includes: a die set assembly having a longitudinal axis; a cutter movable on the longitudinal axis with respect to said die set assembly; a crimper; means for adjustably positioning the cutter relative to the crimper; terminal wire length positioning means; and means for locking said means for adjustably positioning said cutter in a position with respect to the die set once the desired terminal length has been set and the terminal length determined.

DESCRIPTION OF THE DRAWINGS

These and other objects of this invention will be apparent from a study of the drawings in which the following figures are noted.

DESCRIPTION OF THE INVENTION

Figure 1:
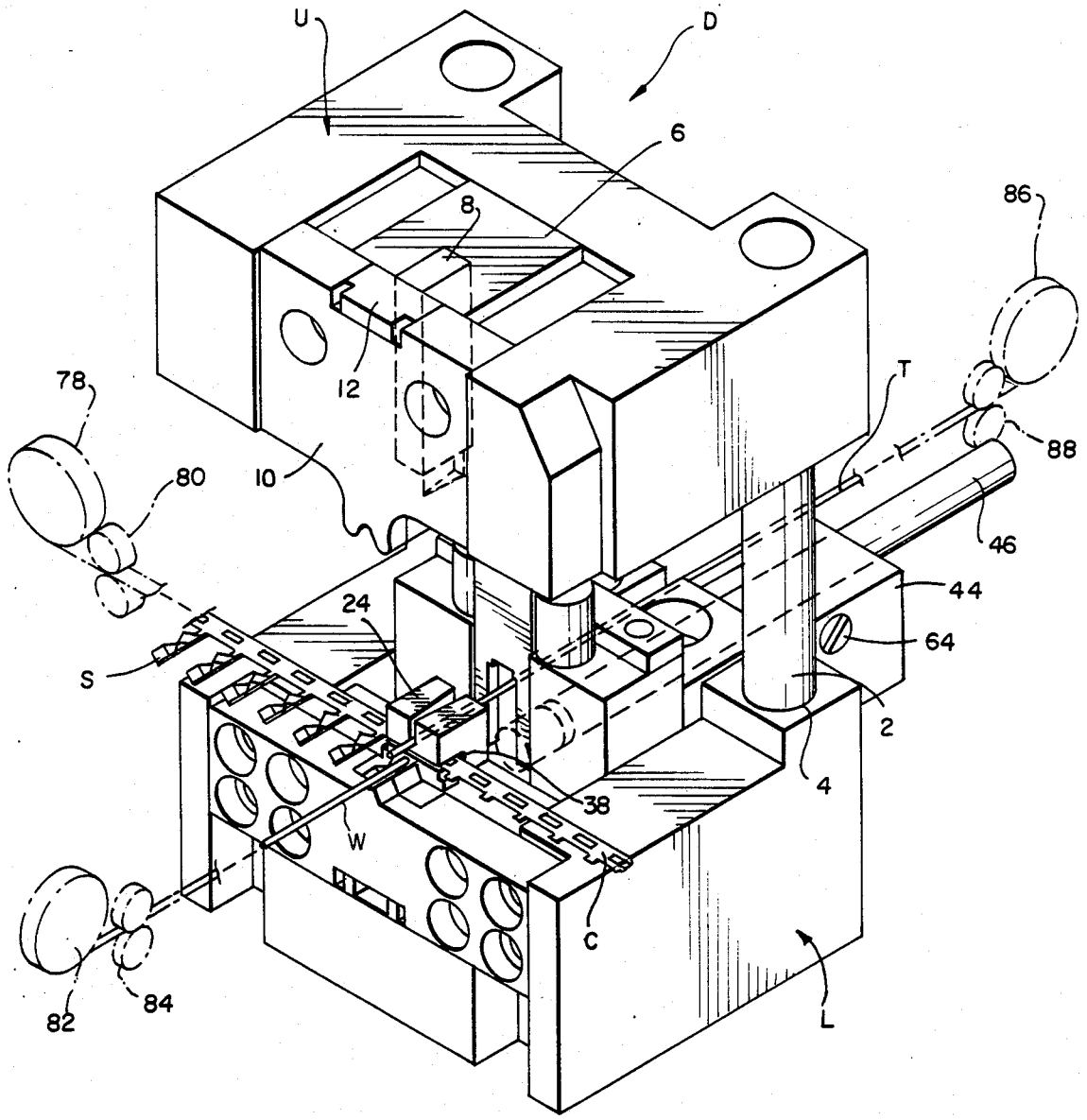
FIG. 1 is a perspective view of an embodiment of the invention.
Figure 2:
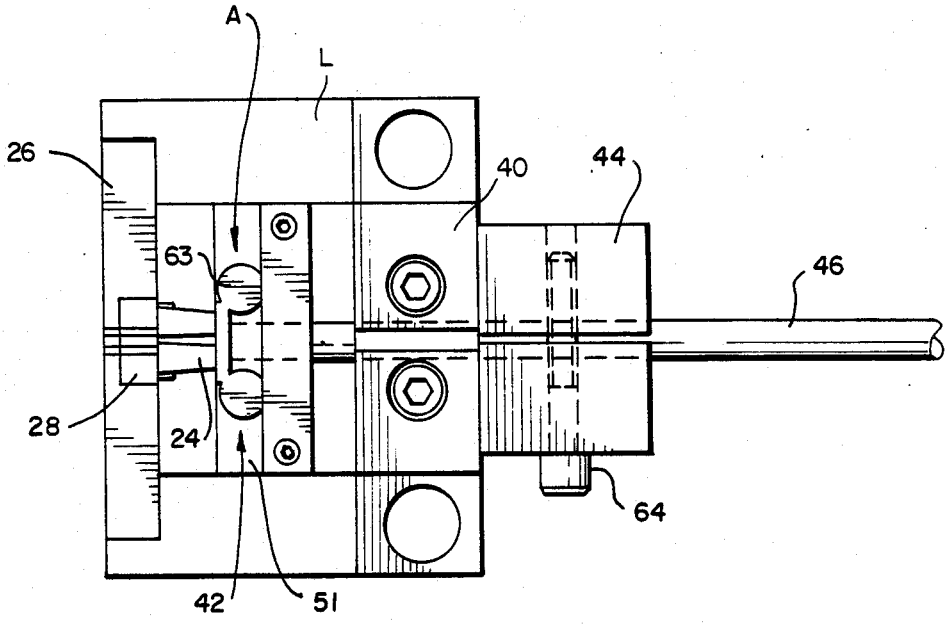
FIG. 2 is a top plan view of the bottom die set showing the movable cut-off punch die holder assembly.
Figure 3:
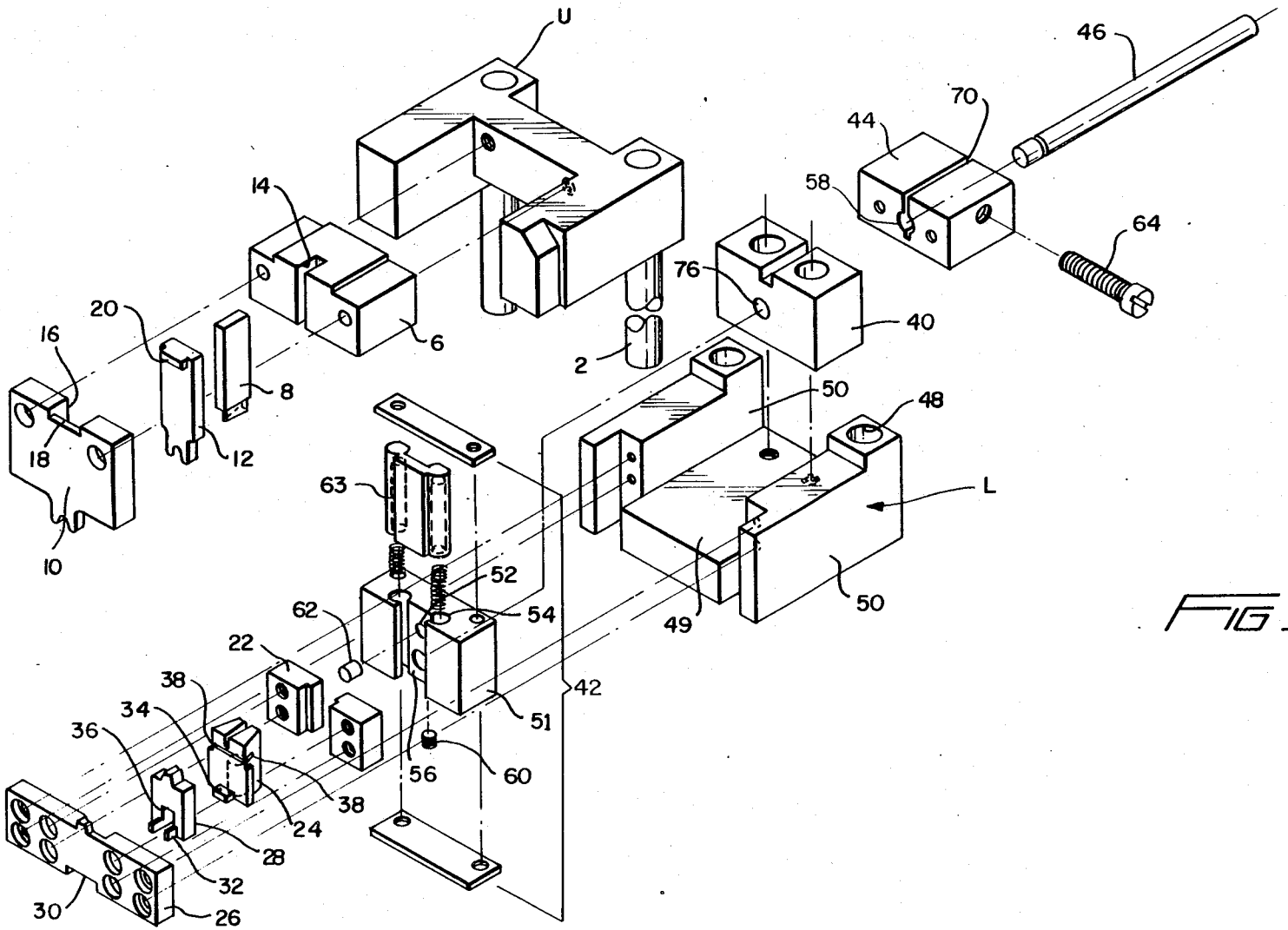
FIG. 3 is an exploded view of the embodiment of the invention illustrated in FIGS. 1 and 2.

FIGS. 1–3 Embodiment

In FIGS. 1–3, the die set generally designated D is made up of upper die set generally designated U which is springingly seated in lower die set generally designated L by means of upper die set posts 2 which mate with lower die set L by way of spring pocket 4.

As is best shown in FIG. 3, upper die set U holds cut-off punch driver 6, pressure pad driver 8, first upper crimp tool 10 and second upper crimp tool 12. Cut-off punch driver 6 has a recessed portion 14 for receiving the pressure pad driver 8. First upper crimp tool 10 has a recessed portion 16 and a lip portion 18 for receiving the second upper crimp tool 12 and second upper crimp tool flange 20. Bolt holes are provided in first upper crimp tool 10 and cut-off punch driver 6 for bolting first upper crimp tool 10, second upper crimp tool 12, pressure driver 8 and cut-off punch driver 6 to the upper die set U. Lower die set L holds filler block 22, lower pressure pad 24, first lower crimp tool 26 and second lower crimp tool 28. Filler block 22 is bolted to lower crimp tool 26 which in turn is bolted to lower die set L. First lower crimp tool 26 is held stationary with respect to second lower crimp tool 28 by means of second lower crimp tool slot 30 and first lower crimp tool flanges 32. Pressure pad 24 is slidingly positioned in filler block 22 and has a flange 34 which is received in slot 36 of first lower crimp tool 28. A slot 38 defined by pressure pad 24 is adapted to receive carrier strip C carrying gold splice crimp S. Attached to the rear portion of lower die set L is a wire holder 40 for positioning the terminal for gold plated wire T. It is apparent that other types of metal or conductive material terminals can be connected by this development.

Adjustment means A is made up of the movable cut-off punch and die holder assembly 42, rod guide 44, and adjustment rod 46. As best shown in FIGS. 2 and 3, the movable punch and die holder assembly 42 is slidingly seated on the base 49 of the lower die set L and positioned between side walls 50. The movable punch and die holder assembly 42 is therefore free to slide in a longitudinal direction up to filler block 22 in the forward portion of lower die set L and the wire holder 40 in the rearward portion of lower die set L. The movable cut-off punch die holder assembly 42 includes die holder 51 which defines cut-off die bore 52, spring pocket bore 54 and adjustment rod bore 56. The adjustment rod 46 is slidingly received by rod guide bore 58 and is fixed in adjustment rod bore 56 by cone point set screw 60. A cut-off die 62 is positioned in cut-off die bore 52 and a cutoff punch 63 is springingly seated in spring pocket bore 54. This structure allows the movable cut-off punch and die holder assembly to be moved along base 49 of the lower die set L, then held fixed by tightening clamp screw 64 which holds adjustment rod 46 in the position desired.

Figure 4:
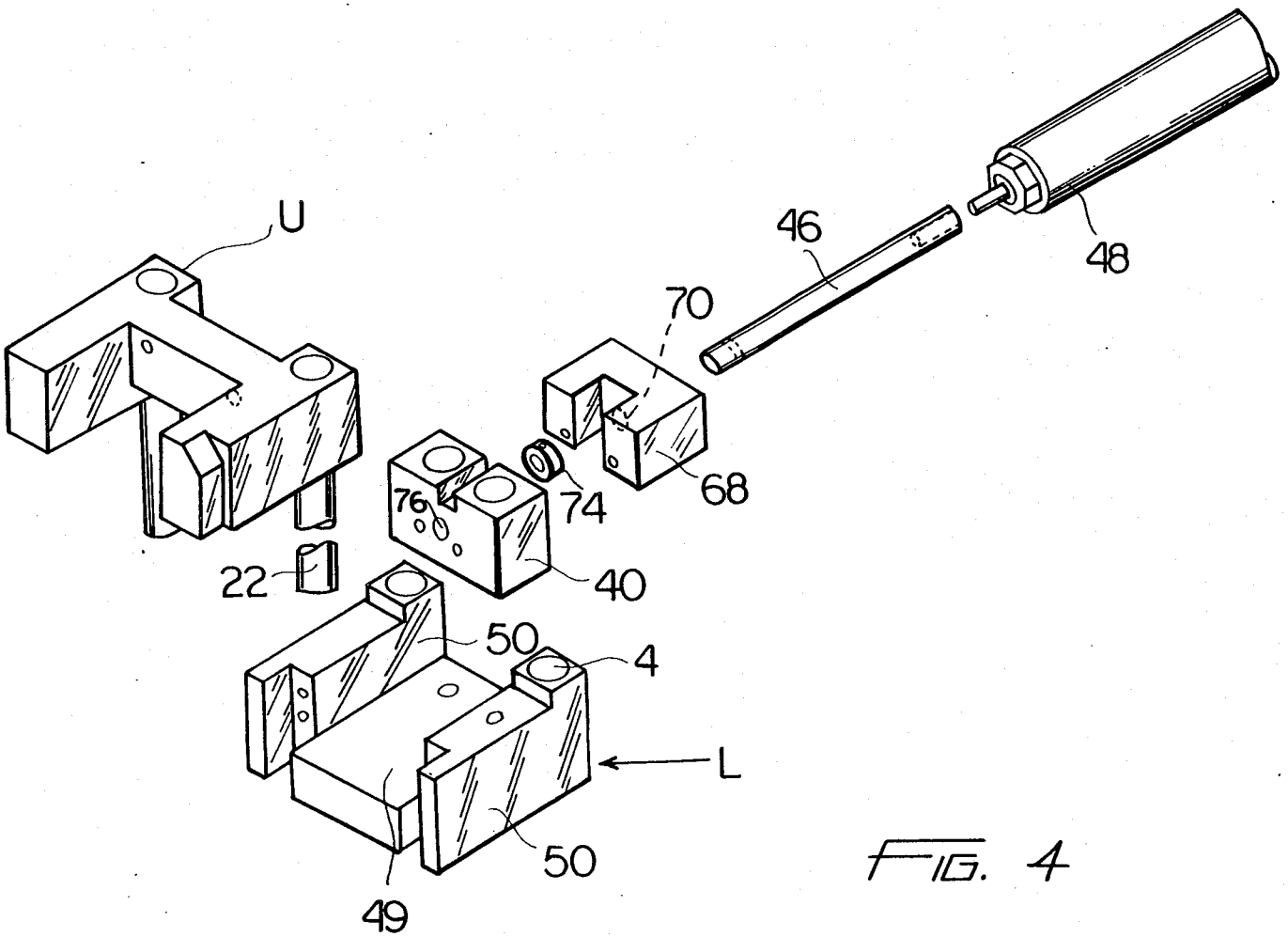
FIG. 4 is an exploded view of the invention showing an alternative rod guide and rod stop which can be substituted for the rod guide shown in FIG. 3 for automatic operation.
Figure 5:
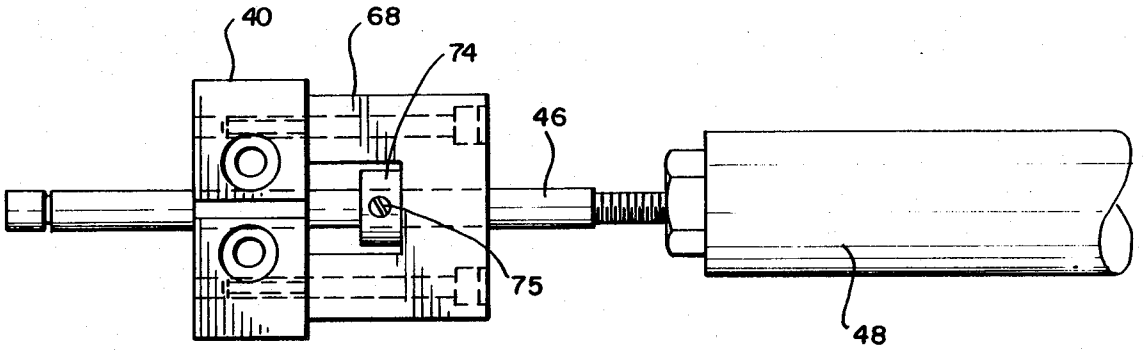
FIG. 5 is a top plan view showing the alternative rod guide and stop of FIG. 4 in a position to produce a long terminal wire.
Figure 6:
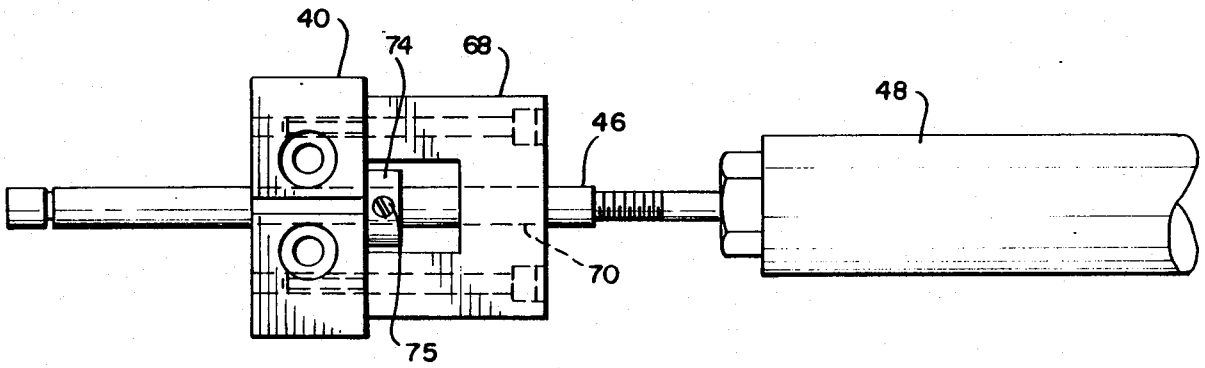
FIG. 6 is a top plan view showing the rod guide and stop device of FIG. 4 in the position to produce a short terminal wire.

FIGS. 4, 5 and 6 Embodiment

FIGS. 4, 5 and 6 show an alternative rod guide structure having a generally U-shaped cross-section when viewed from top. Rod guide 68 includes rod guide bore 70 for receiving the adjustment rod. The adjustment rod passes through rod guide 68, stop 74, bore 76 and then is fixed to die holder 51, the same as shown in FIGS. 2–3 with reference to the previously described embodiment, by means of adjustment rod bore 56 and cone point set screw 60. With this configuration, stop 74 may be adjusted and different wire lengths may be obtained by presetting stop 74 so that in a first position, stop 74 comes in contact with the side wall of wire holder 40, thereby producing a shorter length wire, and in a second position, stop 74 comes in contact with rod guide 68, thereby producing a longer length wire.

OPERATION

In the operation shown in FIG. 1, carrier strip C carrying gold splice crimp S is fed into the die set assembly and positioned so that gold splice crimp S is directly above lower crimp tools 26 and 28 and directly beneath upper crimp tools 10 and 12. Carrier strip C is fed off carrier strip spool 78 by means of carrier strip feed 80. Insulated wire W is fed off insulated wire spool 82 by means of insulated wire feed 84 and is then positioned above gold splice crimp C. Gold plate terminal wire T is fed off gold plated terminal wire spool 86 through wire holder guide 88, through cut-off die 62, until the gold plated terminal wire's first end lies above the gold splice crimp C.

When the insulated wire W, the gold plated terminal wire T are each positioned above different ends of the gold splice crimp C, the desired wire length may be selected by moving the adjustment rod 46, thereby positioning the movable cut-off punch 63 and die holder assembly 51, so the cut-off punch 63 will cut the desired length of gold plated terminal wire. The clamp screw 64 is then tightened, holding adjustment rod 46 in a fixed position. Alternatively, in the die set shown in FIGS. 4, 5 and 6, stop 74 is set so that two wire lengths may be obtained automatically, as described hereinabove. The stroke of rod 46 may be varied so as to produce more than two wire lengths. In the embodiments shown, the stroke of rod 46 in FIG. 5 is with the piston rod of cylinder 48 fully retracted. In FIG. 6, the piston rod of cylinder 48 is fully extended. This is an easily programmed system for the automatic production of two wire lengths. More sophisticated driving devices with more complex controls and locating units than the stops 74 may be utilized for a completely automated set of preprogrammed wire lengths.

A conventional ram (not shown) descends on the cut-off punch driver 6. The gold plated terminal wire T is cut off and the cut-off punch driver strikes the cut-off punch 63, driving it past the cut-off die 62. The gold plated terminal wire T is then trapped between the pressure pad driver 8 and the pressure pad 24. The gold splice crimp S is cut free from the carrier strip C as the pressure pad driver 8 drives the pressure pad 24 past the lower crimp tools 26 and 28. At the lower end of the ram stroke, the gold plated terminal wire T, the gold splice crimp C and the insulated wire W are all crimped together into an assembled unit.

While this invention has been described as having preferred design, it is understood that it is capable of further modification, uses and/or adaptations of the invention following in general the principle of the invention and including such departures from the present disclosure as come within known or customary practice in the art to which the invention pertains, and as may be applied to the essential features set forth, and fall within the scope of the invention of the limits of the appended claims.

What we claim is:

1. A machine for crimp connecting an electrical lead to a terminal, the machine including means for cooperatively feeding a length of electrical lead wire, a length of terminal wire, and a crimp connector strip carrying a series of crimp connectors, the improvement comprising:

(a) a die set assembly having a longitudinal axis therethrough along which a length of electrical lead wire and a length of terminal wire are fed;

(b) crimper means positioned on said longitudinal axis for crimping a crimp connector, a lead wire and a terminal wire together;

(c) a cutter assembly disposed in said die set assembly on said longitudinal axis and adpated for cutting a terminal wire to a length dependent upon the distance between said cutter assembly and crimper means as measured along said axis;

(d) means for adjusting the distance between said cutter assembly and said crimper means to adjust the length of a terminal wire to be cut by said cutter means, said means for adjusting including i. a support member fixedly disposed in said die set assembly on said longitudinal axis; and ii. a movable member extending along said longitudinal axis between said support member and said cutter assembly, positionable within said support member and secured to said cutter assembly such that movement of said movable member along said longitudinal axis causes corresponding movement of said cutter assembly; and (e) means for locking said adjustng means to fix a preselected distance between said cutter assembly and crimper means as measured along said longitudinal axis once a desired terminal wire length has been chosen whereby when a length of electrical lead wire, and crimp connector strip have been positioned in the die set assembly, and said terminal wire length determined, said die set assembly will crimp connect a lead wire and a terminal wire to a crimp connector and will sever said crimp connector from said strip and cut a predetermined length of terminal.

2. A machine for crimp connecting an electrical lead to a terminal as in claim 1, wherein said means for locking said means for adjusting comprises:

(a) clamping means connected to said support member and engagable with said movable member; and (b) means for tightening said clamping means tightly around said movable member to render said movable member immovable for locking said cutter assembly at a selected distance along said longitudinal axis from said crimper means.

3. A machine for crimp connecting an electrical lead to a terminal as in claim 1, wherein:

(a) said movable member is an adjustment rod.

4. A machine for crimp connecting an electrical lead to a terminal as in claim 3 wherein:

(a) said adjustment rod includes a groove surrounding an end portion thereof; and (b) said cutter assembly includes means engagable with said groove to lock said rod end portion fixed in said cutter assembly.

5. A machine for crimp connecting an electrical lead to a terminal as in claim 3 wherein:

(a) said cutter assembly defines an opening for positioning said rod; and (b) said cutter assembly has a locking means for locking said rod relative to said cutter assembly.

6. A machine for crimp connecting an electrical lead to a terminal as in claim 5, wherein:

(a) said means for locking said rod relative to said cutter assembly is a set screw.

7. A machine for crimp connecting an electrical lead to a terminal as in claim 2, wherein said clamping means comprises a block defining a hollow, cylindrically shaped shaft through which said movable member extends and a channel extending the length of and communicating with said shaft which opens onto and along a surface of said block.

8. A machine for crimp connecting an electrical lead to a terminal as in claim 7 wherein said tightening means comprises a screw, said block defines a bore threaded in conformity wit said screw through one side of said block and across and beyond said channel, said screw is adapted to decrease the width of said channel and thus tighten said shaft around and upon said movable member.

9. A machine for crimp connecting an electrical lead to a terminal as in claim 1 wherein said adjusting means comprises:

(a) support means disposed in said die set assembly and fixedly positioned along said longitudinal axis, said support means defining a gap therein which extends along a portion of said axis;

(b) a movable member extending between said support means and said cutter assembly, positionable within said support means and secured to said cutter assembly such that movement of said movable member along said longitudinal axis causes corresponding movement of said cutter assembly; and (c) stop means disposed in said gap and fixedly attached to said movable member for movement therewith along said longitudinal axis between a forward and a rear end of said gap, said stop means thereby limiting the forward and rearward movement of said movable member.

10. The machine of claim 9 further comprising means for driving said movable member in forward and rearward directions between limits defined by said gap to change the distance between said cutter assembly and crimper for alternately cutting terminal wires to two different lengths.

11. The machine of claim 10 wherein said driving means is a fluid operated cylinder attached to one end of said movable member.

12. The machine of claim 9 wherein said movable member is an elongated rod.

13. The machine of claim 9 wherein said support means comprises:

(a) a U-shaped member defining one end of said gap; and (b) a second member disposed next to said U-shaped member along said longitudinal axis and defining the other end of said gap, said U-shaped and second members being fixedly connected to one another, said U-shaped and second members defining aligned bores therethrough which said movable member is disposed.

14. A machine for crimp connecting an electrical lead to a terminal comprising:

(a) a stationary lower die having a longitudinal axis;

(b) an upper die disposed over said lower die and being movable vertically with respect to said lower die;

(c) crimp connector means connected to a forward end portion of said upper and lower die in line with said longitudinal axis;

(d) cutter means disposed between said upper and lower die rearwardly of said crimp connector along said longitudinal axis, said cutter means being operative in response to downward vertical movement of said upper die and being movable horizontally along said longitudinal axis to alter the distance between said crimp connector means and said cutter means;

(e) means for positioning said cutter means along said longitudinal a±is to change said distance, said means for positioning including an adjustment rod disposed between said upper die and said lower die rearwardly of said cutter means aligned for movement forwardly and rearwardly along said longitudinal axis, a forward end portion of said rod being fixedly connected to said cutter means, and (f) means for locking said cutter means in a preselected position along said longitudinal axis to set a preselected distance distance between said crimp connector means and said cutter means, said means for locking locking i. a block disposed between said upper die and said lower die rearwardly of said cutter means at a fixed position on said longitudinal axis and defining a hollow shaft therethrough through which said rod s1idably extends; and ii. means for selectively rendering said rod immovable in said shaft for locking said cutter means at a selected distance from said crimp connector means.

15. A machine for crimp connecting an electrical lead to a terminal comprising:

(a) a stationary lower die having a longitudinal axis;

(b) an upper die disposed over said lower die and being movable vertically with respect to said lower die;

(c) crimp connector means connected to a forward end portion of said upper die and said lower die in line with said longitudinal axis;

(d) cutter means disposed between said upper die and said lower die rearwardly of said crimp connector along said longitudinal axis, said cutter means being operative in response to downward vertical movement of said upper die and being movable horizontally along said longitudinal axis to alter the distance between said crimp connector means and said cutter means;

(e) means for positioning said cutter means along said longitudinal axis to change said distance, said means for positioning including an adjustment rod disposed between said upper die and said lower die rearwardly of said cutter means aligned for movement forwardly and rearwardly along said longitudinal axis, a forward end portion of said rod being fixedly connected to said cutter means; and (f) means for locking said cutter means in a preselected position along said longitudinal axis to set a preselected distance between said crimp connector means and said cutter means, said means for locking including i. a support member disposed between said upper die and said lower die and fixedly positioned rearwardly of said cutter means along said longitudinal axis, said support member defining a gap therein which extends along a portion of said axis, said adjustment rod extending through said support member and gap, and ii. a stop member fixedly connected to said adjustment rod and disposed in sAid gap for movement across said gap between limits defined by forward and rearward defining walls of said gap, whereby the forward and rearward movment of said adjustment rod and cutter means is corresponding limited.

* * * * *